United States Patent [19]

Evert

[11] 4,137,586

[45] Feb. 6, 1979

[54] SURVIVAL SUIT

[75] Inventor: Karla R. Evert, St. Cloud, Minn.

[73] Assignee: Stearns Manufacturing Company, St. Cloud, Minn.

[21] Appl. No.: 814,719

[22] Filed: Jul. 11, 1977

[51] Int. Cl.[2] ..... B63C 9/08

[52] U.S. Cl. ..... 9/341; 9/347

[58] Field of Search ..... 9/340, 341, 342, 344, 9/345, 346, 347, 349, 329, 337; 2/93, 95, 97

[56] References Cited

U.S. PATENT DOCUMENTS

| | | | |
|---|---|---|---|
| 1,002,912 | 9/1911 | Guy | 9/20 |
| 1,968,197 | 7/1934 | Gazelle | 9/341 |
| 2,608,690 | 9/1952 | Kolb | 9/341 |
| 2,692,994 | 11/1954 | King | 9/20 |
| 2,722,020 | 11/1955 | Gazelle | 9/20 |
| 3,199,128 | 8/1965 | Nöjd | 9/341 |
| 3,266,069 | 8/1966 | O'Link | 9/341 |
| 3,744,052 | 7/1973 | Rector | 2/2.1 |
| 3,805,308 | 4/1974 | Hirsch | 9/340 |
| 3,840,900 | 5/1973 | Cruz | 2/77 |
| 4,015,300 | 4/1977 | Hayward | 9/341 |

FOREIGN PATENT DOCUMENTS

| | | | |
|---|---|---|---|
| 5543 | 5/1906 | France | 9/340 |
| 1375266 | 9/1974 | France. | |

*Primary Examiner*—Galen L. Barefoot
*Assistant Examiner*—D. W. Keen
*Attorney, Agent, or Firm*—Merchant, Gould, Smith, Edell, Welter & Schmidt

[57] ABSTRACT

A survival suit having flotation and hypothermia protection characteristics. The suit includes an outer jacket and an inner jacket adapted to fit snugly about the torso of the wearer thereby minimizing any exchange of cold water. In the event of penetration of a small amount of water, the inner jacket is designed to entrap an insulating layer of water against the torso when immersed whereby high heat loss areas of the torso are thermally insulated. The outer jacket is provided with flotation material adequate to keep an adult afloat.

8 Claims, 8 Drawing Figures

FIG. 4
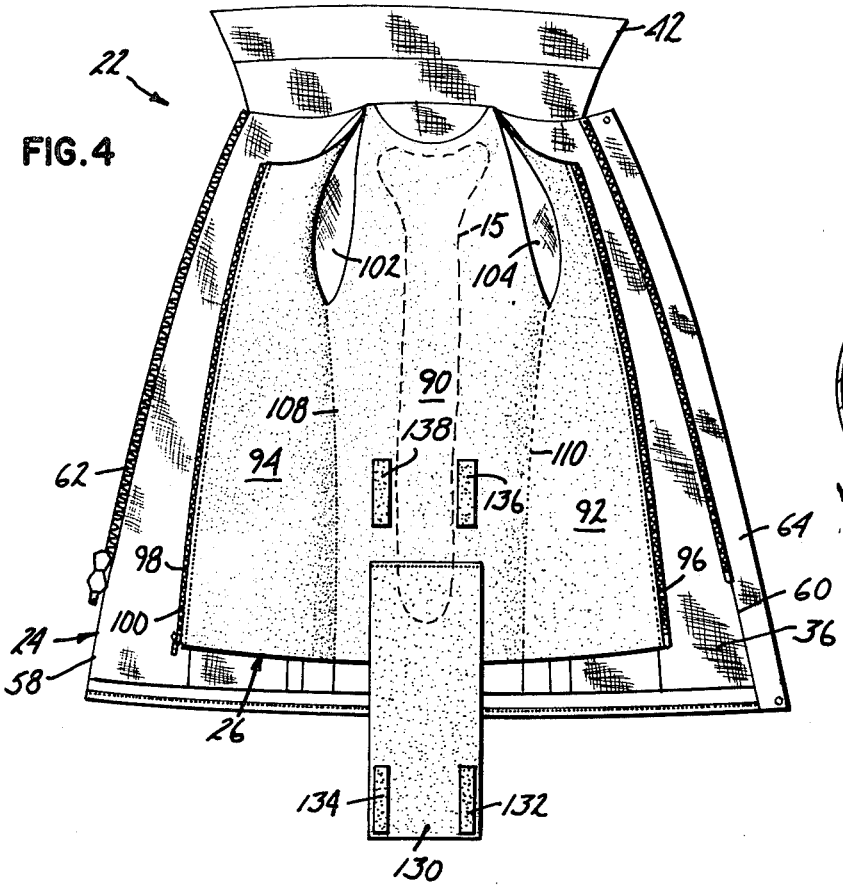
FIG. 6
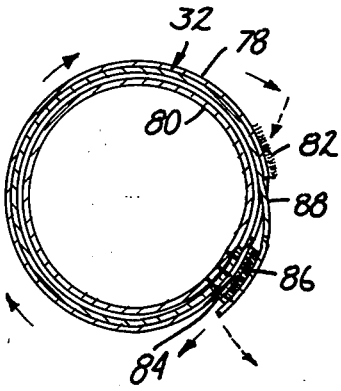
FIG. 5
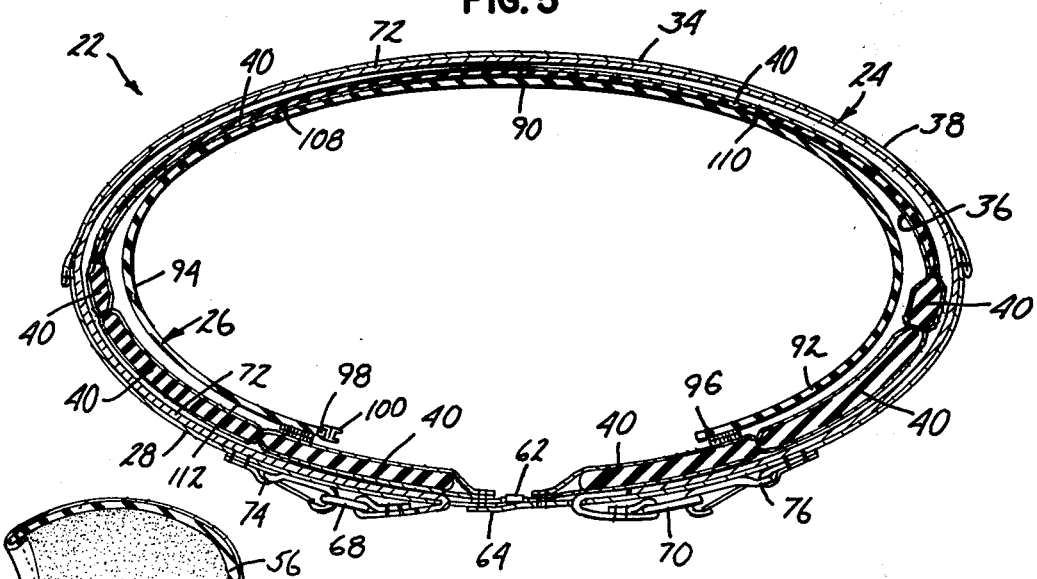
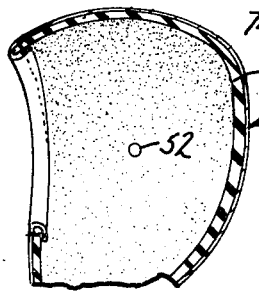
FIG. 7

SURVIVAL SUIT

BACKGROUND OF THE INVENTION

The present invention relates broadly to a survival device designed to be worn by individuals involved in recreational or work activities in which the possibility exists that the individual will be accidentally immersed in cold water. In particular, the present invention is a survival suit having flotation properties capable of supporting an adult, and which provides thermal protection to prevent hypothermia of the individual when immersed in cold water for a substantial length of time.

Commercial fishing boats, recreational and other water craft often are operated in relatively cold water. Additionally, off-shore drilling platforms are frequently located in severe cold water environments. Individuals engaged in such activities in cold water environments are subject to the potential dangers of being accidentally immersed in cold water for substantial periods of time before they are rescued. The greatest danger other than drowning in such circumstances is from the rapid loss of body heat, or hypothermia, which results in death. Generally the individual's heart will fail when the body cools to about 85 degrees F. or below.

Several factors are involved in determining the amount of time that one can survive in cold water. These factors include the survival procedure utilized. If the individual is required to tread water, the body loses heat at a much faster rate than if the individual remained motionless. Swimming also results in an increased rate of body heat loss. Other factors involved include the weight of the individual and the amount of body fat. As a general rule, the predicted survival time of an individual in water of 50 degrees F. averages between two and one-half to three hours, It is desirable, therefore, to minimize the physical activity of the individual immersed in cold water, and to maximize the thermal protection against body heat loss. Certain regions of the body have higher rates of heat loss and must be thermally insulated. These areas include the head, the antero-lateral neck region where the carotid arteries connecting the heart to the head region are located, the sides of the thorax or chest region, the heart region of the thorax, and the groin region where blood and lymph vessels are near the skin surface. The thoracic-duct area of the back is also a high heat loss region. The thoracic duct is the largest lymphatic vessel in the body and is located along the vertebral column and serving tp convey lymph to the left subclavian vein where the lymph enters the circulatory system. To minimize the individual survival activity, flotation means must be provided to keep the individual afloat without physical exertion. Additionally, to minimize the dangers of hypothermia and maximize survival time in the water, it is desirable to provide effective thermal insulation for the high heat loss areas of the body.

Conventional life jackets typically have only flotation characteristics. The individual wearing such conventional jackets may assume a posture in the water that somewhat lessens heat loss. In this posture, the arms are held tightly to the sides of the chest with the legs together and knees drawn upward toward the chest. Although this posture may lessen the heat loss somewhat, it is highly inefficient and the survival time is not significantly increased.

Survival time has been increased somewhat in one prior art flotation jacket disclosed in U.S. Pat. No. 4,015,300 to Hayward et al. This prior art jacket has flotation material therein adequate to keep an adult afloat. A flap of waterproof insulating material is secured on the inside of the jacket proximate the bottom edge and can be released to wrap around the lower trunk of the wearer providing thermal protection in cold water. The flap is drawn between the wearer's legs and wrapped around the upper legs and thighs and secured to the outside of the flotation jacket. In this prior art jacket, although the high heat loss area in the groin region is covered, the only thermal insulation for the other high heat loss areas of the thorax is the insulative properties of the flotation material and jacket lining. Although the flap portion may prevent substantial amounts of water from entering the jacket in the area of the thighs, cold water may still find its way through the jacket zipper and arm portions into contact with the chest region resulting in a rapid heat loss from the thorax, particularly the sides of the chest. In addition, there may be some reluctance to wearing this prior art flotation jacket with the flap properly positioned about the upper legs and thighs and attached to the outside of the jacket since the flap provides a diaper-like external appearance. The prior art jacket may lose its effect if the wearer does not secure the flap about his thighs and groin area before he finds himself in the water. By this time, a substantial amount of water would enter the jacket, cooling the thorax region.

The present invention eliminates the disadvantages of the conventional prior art flotation jackets and the flotation jacket disclosed in the above mentioned U.S. patent in that it provides thermal protection for the major areas of heat loss from the body in addition to having flotation characteristics. In particular, the present invention is a survival suit having an outer jacket and an inner jacket. The inner jacket is attached to the inner lining of the outer jacket and is adapted to fit snugly about the torso of the body providing thermal protection for the major areas of heat loss of the thoracic anterior and dorsal regions. A crotch flap is provided that is positioned between the legs of the wearer and secured to the front of the inner jacket providing additional thermal protection for the groin area of the body. When the inner jacket is in place snugly about the torso it is entirely concealed from view by the outer jacket. The outer jacket presents an aesthetically pleasing look thereby encouraging the wearer of the survival suit to have the inner jacket in place while on board the water craft. The snug fit of the inner jacket minimizes cold water contact with the torso. In the event of penetration of a small amount of water into contact with the torso, the inner jacket serves to entrap an insulating layer of water that is heated by body heat and to minimize the exchange of cold water with the heated layer. The high heat loss areas of the torso are thereby thermally insulated.

SUMMARY OF THE INVENTION

The present invention is a survival suit that includes an outer flotation jacket having flotation material therein. The survival suit also includes an inner jacket having back and front portions that are sized to fit snugly to the torso of the wearer to thermally protect the major areas of heat loss from the torso and means for securing the inner jacket within the outer jacket. The survival jacket further includes a means for preventing the jacket from riding up on the body due to the buoyancy of the flotation material when the jacket is immersed. In the preferred embodiment of this preventing means is a crotch flap having one end affixed to the back portion of the outer jacket. The crotch flap is adapted to fit snugly about the groin of the torso with a free end thereof attached to the front portion of the inner jacket.

The inner jacket is preferably formed of a water impervious closed cell flexible and stretchable elastomeric material, such as neoprene. A collar member of similar material is provided for thermal protection of the anterolateral neck region. A hood is fixed to the outer jacket and when secured about the head thermally protects the head region and retains the collar about the neck. The outer jacket includes wrist bands that may be tightened about the wrist to prevent the entrance of water into the arm portions of the outer jacket. Lift rings are secured to the outer jacket and attached to a belt that extends substantially about the entire outer jacket within the lining thereof facilitating rescue of the wearer. Additionally, strips of reflective material may be attached to the outer jacket to aid in night rescue operations.

In the preferred embodiment, the inner jacket is affixed to the inner lining of the outer jacket and the front portion of the inner jacket further comprises front panel members each having a free edge with cooperating fastening means to selectively secure the free edges together. The exterior surface of the front panels and the inner lining of the outer jacket have cooperating releasable fastening means such that the front panels are secured to the inner lining when the inner jacket is not in use. The crotch flap and inner surface of the inner jacket are also provided with cooperating releasable engagement members such that the crotch flap can be secured when it is not placed between the legs and about the groin area. Releasable engagement means are also provided on the exterior surface of the inner jacket to which the cooperating fastening means on the crotch flap are attached when the inner jacket is secured snugly about the torso and the crotch flap is placed between the legs.

As previously mentioned, the inner jacket provides thermal protection for the high high loss areas of the torso, including the groin region, the sides of the thorax, and the heart region, and the thoracic duct region of the back. Additionally, the collar member protects the anterolateral neck region while the head is covered by the outer jacket hood. The present invention thus minimizes heat loss thereby maximizing survival time in cold water. The outer jacket provides an aesthetically pleasing external appearance and conceals the inner jacket thus encouraging the use of the inner jacket when the wearer is aboard the water craft. These and other advantages of my invention will become apparent with reference to the accompanying drawings, detailed description of the preferred embodiment, and claims.

BRIEF DESCRIPTION OF THE DRAWINGS

FIG. 4 is a view in elevation of the present invention with both inner and outer jackets open;

FIG. 5 is a sectional view of the present invention taken along a line 5—5 of FIG. 2;

FIG. 6 is a sectional view of an arm portion of the survival suit of the present invention taken along line 6—6 of FIG. 2;

FIG. 7 is an enlarged sectional fragmentary detail of the hood of the survival suit of the present invention.

DETAILED DESCRIPTION OF THE PREFERRED EMBODIMENT

Figure 1:
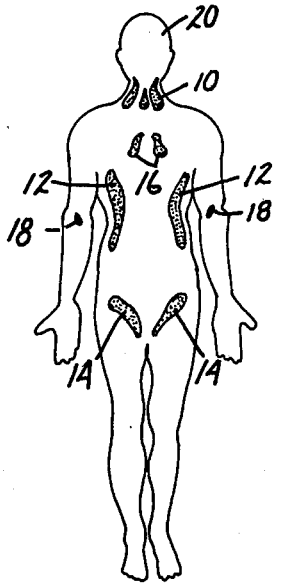
FIG. 1 is an illustration of the high heat loss areas of the anterior of the human body taken from a thermogram.

Referring to the drawings, wherein like numerals represent like parts throughout the several views, FIG. 1 depicts a thermogram in which the shaded areas illustrate those regions of the most significant heat loss from the torso of the human body. Such areas include the anterolateral portion of the neck 10 where the carotid arteries lead from the heart to the head region. Significant torso heat loss also occurs along the sides 12 of the chest or thorax region, in the groin area 14, and along the thoracic duct region of the back 15. Smaller regions of heat loss are the heart area 16 and in areas 18 on the inside of the arms at the elbow. Although it is not shaded in FIG. 1, the head 20 is also a significant area of heat loss from the body. Therefore, in order to extend the life expectancy of those who may be required to spend considerable lengths of time in the water after boat mishaps or other water craft accidents, or for any other number of reasons, it is necessary to not only provide flotation means but also to thermally insulate these major areas of heat loss.

Figure 2:
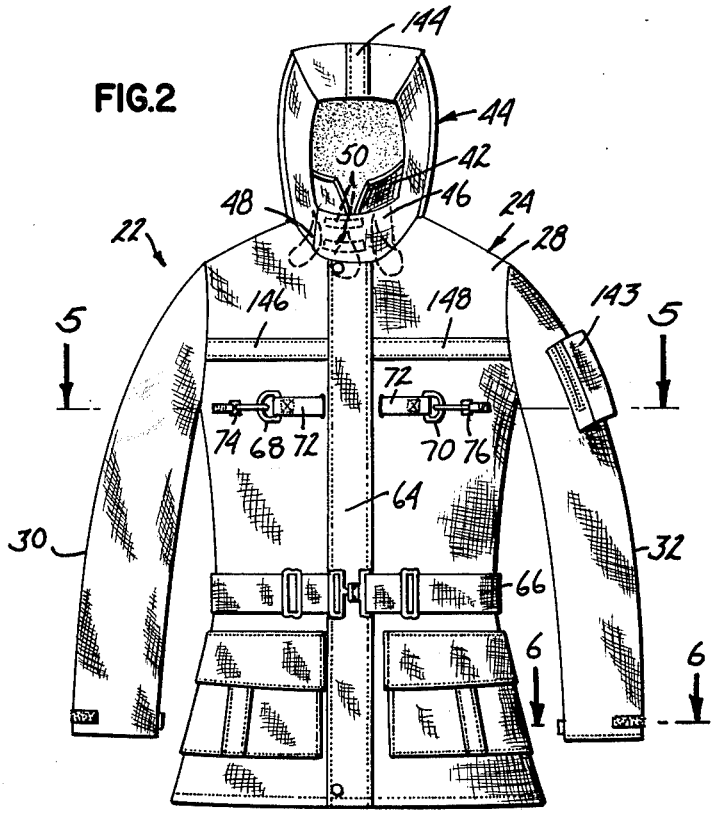
FIG. 2 is a view in elevation of the survival suit of the present invention as it would look when worn.
Figure 1A:
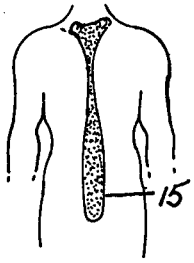
FIG. 1*a* is an illustration of the high heat loss areas of the dorsal thoracic region of the human body.

The survival suit of the present invention which has these qualities of effective thermal insulation of the body and flotation is illustrated in FIG. 2 and designated generally as 22. Survival suit 22 includes an outer jacket 24 and an inner jacket 26 shown more particularly in FIGS. 3 and 4. Outer jacket 24 has a front portion 28, arm portions 30 and 32, and a back portion 34. Outer jacket 24 includes an inner lining 36 and an outer lining 38 as shown in more detail in FIG. 5. Sewn within linings 36 and 38 are segments of flotation material as illustrated at 40. Flotation material is typically a closed cell foam material having sufficient buoyancy to keep an adult afloat. Segments of flotation material 40 will be somewhat thicker in front portion 28 than in back portion 34 of outer jacket 24. Affixed at the top end of outer jacket 24 is a collar member 42. Collar member 42 is formed of a thermally insulating material and is disposed to protect the anterolateral neck and lower head regions against heat loss. In the preferred embodiment, collar member 42 is a closed cell elastomeric material covered by a suitable cloth outer layer. Also affixed at top end of outer jacket 24 is a hood 44. Hood 44 covers and protects the head region against heat loss and may be a cloth covered closed cell elastomeric foam, for example, neoprene. Hood 44 includes a pair of overlapping front flaps 46 and 48 each of which is provided with cooperating fastening means as indicated at 50 to secure front flaps 46 and 48 about the front neck region. Fastening means 50 may be any convenient fastening mechanism and in the preferred embodiment fastening means 50 comprises a pair of strips of synthetic material having hooks and loops which adhere to each other when pressed together and are manufactured under the registered trademark VELCRO, Reg. No. 661,700. As shown in FIG. 2, hood 44 secures collar member 42 in an upright position covering the anterolateral neck region 10 and the lower head region. As shown in FIG. 7, the elastomeric foam material of hood 44 is provided with ear apertures 52. Aperture 52 will not expose the head region to the environment as aperture 52 will still be covered by an outer layer 54 of cloth material. However, aperture 52 in elastomeric material layer 56 will increase the hearing capabilities of the wearer of survival jacket 22 when hood 44 is secured about the head.

Front portion 28 of outer jacket 24 includes a pair of front panels 58 and 60 which are secured together by a zipper 62. Front panel 60 has an overlapping flap portion 64 which covers zipper 62 as shown in FIG. 2 to serve as a weather flap. An adjustable belt 66 is provided to secure other jacket 24 in a tapered fit to the wearer's torso. Outer jacket 24 also has a pair of D rings 68 and 70 to which a hook could be attached to lift the wearer from the water. D rings 68 and 70 are attached to a belt 72 which extends about survival suit 22 between outer lining 38 and segments of flotation material 40. Belt 72 is positioned proximate the armpit region of survival suit 22 so that the wearer may be lifted just below the armpits. When not in use D rings 68 and 70 are attached to spring clip hooks 74 and 76 that are sewn to outer lining 38. D rings 68 and 70 are thus held so that they will not become entangled with machinery or boating lines, etc. When it is necessary to lift the wearer from the water D rings 68 and 70 are simply released from hooks 74 and 76 and attached to a lifting hook (not shown) which could, for example, be a lift line attached to a pulley carried by a hovering aircraft.

Arm portions 30 and 32 of outer jacket 24 are provided with a means for tightening the sleeves about the wrist as shown more particularly in FIG. 6. FIG. 6 is a sectional view of arm portion 32 and it will be understood that arm portion 30 has an identical tightening structure. Arm portion 32 has an outer material layer 78 and an inner layer 80. Affixed to outer layer 78 are VELCRO fastening strips 82 and 84. A cooperating VELCRO fastening strip 86 is secured to a flexible band 88 which extends about the entire circumference of arm portion 32 between outer and inner layers 78 and 80 and which is sewn to outer and inner layers 78 and 80 at one end thereof. Cooperating VELCRO fastener 86 is secured to the free end of flexible band 88. In a normal un-tightened configuration, VELCRO fasteners 84 and 88 are engaged and flexible band 88 is in a relaxed state. When it is desired to tighten the arm portion 32 about the wrist of the wearer, VELCRO fasteners 84 and 86 are separated and flexible band 88 is stretched in the direction shown by the arrows about the outer circumference of layer 78 and is engaged with VELCRO fastening strip 82. Flexible band 88 tightens the arm portion 32 about the wrist substantially reducing any inflow of water if the wearer becomes immersed and also provides an insulating effect when the wearer is not in the water simply by preventing air from entering outer jacket 24 through the arm openings about the wrist of a wearer.

Figure 3:
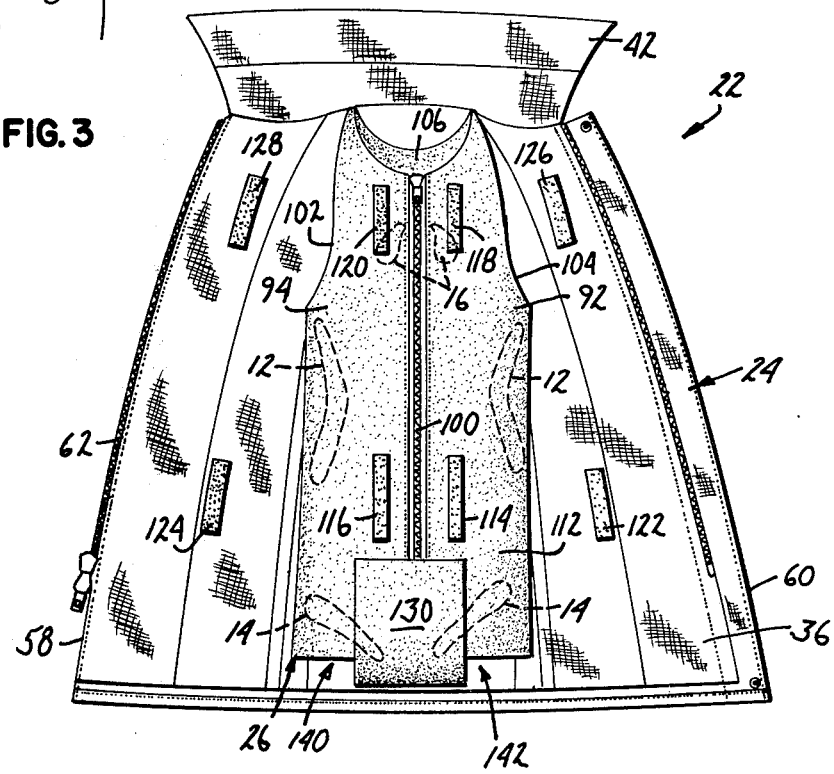
FIG. 3 is a view in elevation of the present invention with the outer jacket open to more particularly illustrate the inner jacket and the areas of heat loss thermally protected by the inner jacket.

Referring to FIGS. 3 and 4, inner jacket 26 of survival suit 22 will now be described. Inner jacket 26 includes a back portion 90 and front panel members 92 and 94. Panel members 92 and 94 extend longitudinally downward from the shoulders towards the groin and laterally about the torso from front to the back. Back portion 90 extends downwardly from the shoulders toward the groin. Front panels 92 and 94 have lateral edges 96 and 98 that are joined at the front of the torso by a zipper fastener 100. Inner jacket 26 has arm openings at 102 and 104 and a neck opening at 106. Inner jacket 26 is affixed to inner lining 36 of outer jacket 24 along at least one permanent seam as shown, for example, at 108 and/or 110. As will be described in more detail hereafter, front panels 92 and 94 are held in releasable engagement against inner lining 36 such that survival suit 22 may be worn with inner jacket 26 fitting snugly about the torso as illustrated in FIG. 3, or may be worn with front panels 92 and 94 of inner jacket 26 affixed to lining 36 in a loose fit about the torso.

Inner jacket 26 has an outer surface 112 to which is affixed a plurality of VELCRO fastening strips 114, 116, 118, and 120. Mating VELCRO fastening strips 122, 124, 126, and 128, respectively, are provided on inner lining 36. FIG. 4 illustrates front panels 92 and 94 of inner jacket 26 attached to inner lining 36 of outer jacket 24 by the releasable engagement of mating VELCRO fastening strips 114–128. Secured to back portion 90 of inner jacket 26 proximate the bottom edge of inner jacket 26 is a crotch flap 130. Crotch flap 130 is designed to be placed between the legs of the wearer from the rear and secured to front panels 90 and 92 of inner jacket 26 as shown in FIG. 3. VELCRO fastening strips 132 and 134 are affixed to crotch flap 130 and mate with exterior VELCRO fastening strips (not shown) on front panels 92 and 94. When inner jacket 26 is not being used, VELCRO fastening strips 132 and 134 are engaged with mating VELCRO fastening strips 136 and 138 affixed to back portion 90 of inner jacket 26. FIG. 4 illustrates crotch flap 130 released from the storage position in which VELCRO fastening strips 132–138 are engaged such that crotch flap 130 is in position for placement between the wearer's legs. FIG. 3, as previously described, shows inner jacket 26 as it would look in snug fit about the torso with crotch flap 130 fastened to front panels 92 and 94. The wearer's legs would extend through openings 140 and 142 defined by inner jacket 26 and crotch flap 130. As shown in dashed lines, the areas of high heat loss near the heart 10, the sides 12 of the chest area, and the groin area 14 would be covered by inner jacket 26 and crotch flap 130. As illustrated by the dash lines in FIG. 4 inner jacket 26 also covers the dorsal thoracic region 15. Inner jacket 26 is preferably a closed cell flexible and stretchable foam elastomeric material, and in one embodiment, is neoprene. The material has good thermal insulation and is substantially waterproof. Inner jacket 26 fits snugly against the shoulders, front, back, and sides of the thorax having extremity openings 102, 104, 106, 140 and 142. Inner jacket 26 performs its thermal insulation function equally well when it is secured snugly about the torso after the wearer becomes immersed. In the event that water enters the openings 102–106 and 140–142 a layer of water becomes entrapped between inner jacket 26 and the torso and is heated by body heat. This heated layer of water remains entrapped against the body by inner jacket 26, and following the initial inflow of water there is substantially little or no exchange of water between the heated water layer against the torso and the water in which the wearer is immersed through openings 102, 104, 106, 140 and 142. The exchange of water between the heated layer about the body and the exterior is eliminated in large part by the snug fit of inner jacket 26. As previously mentioned, inner jacket 26 is formed of a stretchable foam material such that inner jacket 26 can be wrapped tightly about the torso while at the same time permitting normal movement of the torso. Crotch flap 130 serves the additional function of preventing survival jacket 22 from riding upward on the body as a result of the buoyancy of the flotation material. While the inner jacket 26 and crotch flap 130 have been described as separate panels, it is understood that crotch flap 130 could be formed integrally with inner jacket 26. Additionally, inner jacket 26 may also be formed of a plurality of panels, such as back and front panels sewn together and sewn to inner lining 36 as opposed to the single panel structure that has been described above.

As illustrated in FIGS. 2 and 3, when inner jacket 26 is snugly secured about the torso, inner jacket 26 and crotch flap 130 are concealed by outer jacket 24. The wearer of survival jacket 22 will, therefore, be less reluctant to wear suit 22 with inner jacket 26 in place than wearers of the prior art survival jacket.

Survival suit 22 may include additional features that are illustrated in FIG. 2. For example, a survival pocket 143 is shown on arm portion 32. Various survival devices and gear may be stored within pocket 142, such as flares, flashlight, candy bars, etc. Outer jacket 24 may also have strips of reflective material as at 144, 146 and 148 to aid in the nightime rescue of individuals wearing survival suit 22.

Thus, from the above description it can be seen that the present invention is a survival suit having flotation and hypothermia-preventing characteristics. A substantial increase in the potential survival time when immersed is achieved by an inner hypothermia-preventing jacket affixed within an outer jacket. The inner jacket covers and thermally insulates the primary high heat loss areas of the human torso. It will be understood that the scope of the invention defined in the following claims is not limited to the structure specifically disclosed herein, and that alternative equivalent structures are also within the spirit and scope of the present invention.

What is claimed is:

1. A survival suit comprising:

(a) a survival jacket, said survival jacket comprising:
  (i) an outer flotation jacket having flotation material therein;
  (ii) an inner jacket of substantially water impervious material having thermal insulation characteristics and elastic properties, said inner jacket sized to fit snugly and conform to the torso of the wearer to provide thermal protection for major areas of heat loss from the torso yet allow for torso movement thereby also providing a comfortable fit;
  (iii) means for securing said inner jacket within said outer jacket; and (b) means including a crotch flap connected to said survival jacket for preventing said jacket from riding upward on the body when immersed, said crotch flap sized to substantially cover and thermally insulate the crotch and groin region of the torso.

2. A survival suit in accordance with claim 1 wherein said outer jacket has an inner lining to which is attached first releasable fastening means and wherein said inner jacket comprises:

(a) a panel having interior and exterior surfaces, a back panel portion, and front panel portions, said front panel portions having free edges that are joined at the front of the wearer's torso; and (b) second releasable fastening means affixed to said exterior surface of said front panel portions, said first and second releasable fastening means cooperating to secure said front portions to said lining;

(c) whereby said survival suit can be worn with said inner jacket fitting snugly about said torso of said wearer or whereby said survival suit can be worn with said front panel portions attached to said inner lining such that said inner jacket loosely encloses said wearer.

3. A survival suit in accordance with claim 2 wherein said preventing means comprises:

(a) a crotch flap having a first end affixed to said survival suit proximate the bottom end thereof, and having a free end, said free end having a third releasable fastening means thereon;

(b) fourth releasable fastening means affixed to said interior surface of said panel, said third and fourth fastening means cooperating to secure said flap in a non-use position; and (c) fifth releasable fastening means affixed to said exterior surface of said panel, said third and fifth fastening means cooperating to secure said crotch flap in a use position with said flap held between the legs of the wearer to cover the crotch and groin region of the body.

4. A survival suit in accordance with claim 1 wherein said inner jacket is formed of a water impervious closed cell elastomeric material.

5. A survival suit in accordance with claim 4 wherein said water impervious closed cell elastomeric material is neoprene.

6. A survival suit adapted to provide flotation for the wearer and to prevent hypothermia of the wearer comprising:

(a) an outer flotation jacket having front, back, and arm portions, and an inner lining, said jacket having flotation material therein;

(b) an inner jacket affixed to said inner lining and sized to fit snugly to the torso of the water, said inner jacket comprising:
  (i) a panel having interior and exterior surfaces, a rear panel portion affixed to said inner lining, and front panel portions releasably attached to said inner lining, said front panel portions having free edges that are joined at the front of the wearer's torso;
  (ii) means affixed to said inner lining and said front panel portions for releasably attaching said front panel portions to said inner linings; and
  (iii) means for securely joining said free edges;

(c) a crotch flap having a first end affixed to said survival jacket proximate the bottom end thereof, said free end having a first releasable fastening means thereon;

(d) second releasable fastening means secured to said inner surface of said panel, said first and second fastening means cooperating to secure said flap in a non-use position; and (e) third releasable fastening means affixed to said exterior surface of said panel, said first and third releasable fastening means cooperating to secure said crotch flap in a use position with said flap held between the legs of the wearer to cover the crotch and groin region of the body;

(f) whereby said survival suit can be worn with said inner jacket fitting snugly about said torso of the wearer or said survival suit can be worn with said front panel portions of said inner jacket attached to said inner lining such that said inner jacket loosely encloses the wearer.

7. A survival suit in accordance with claim 6 wherein said inner jacket is formed of a closed cell water impervious stretchable elastomeric material.

8. A survival suit comprising:

(a) a survival jacket, said survival jacket comprising:

(i) an outer flotation jacket having flotation material therein and an inner lining to which is attached first releasable fastening means;

(ii) an inner jacket of substantially water impervious material having thermal insulation characteristics and sized to fit snugly the torso of the wearer to provide thermal protection for major areas of heat loss from the torso; said inner jacket comprising a panel having interior and exterior surfaces, a back panel portion, and front panel portions, said front panel portions having free edges that are joined in the front of the wearer's torso, and said releasable fastening means affixed to said exterior surface of said front panel portions, said first and second releasable fastening means cooperating to secure said front portions to said lining whereby said survival suit can be worn with said inner jacket fitting snugly about said torso of said wearer or whereby said survival suit can be worn with said front panel portions attached to said inner lining such that said inner jacket loosely encloses said wearer;

(iii) means for securing said inner jacket within said outer jacket; and (b) means connected to said survival jacket for preventing said jacket from riding upward on the body when immersed, said preventing means comprising:

(i) a crotch flap having a first end affixed to said survival suit proximate the bottom end thereof, and having a free end, said free end having a third releasable fastening means thereon;

(ii) fourth releasable fastening means affixed to said interior surface of said panel, said third and fourth fastening means cooperating to secure said flap in a non-use position; and (iii) fifth releasable fastening means affixed to said exterior surface of said panel, said third and fifth fastening means cooperating to secure said crotch flap in a use position with said flap held between the legs of the wearer to cover the crotch and groin region of the body.

* * * * *

UNITED STATES PATENT AND TRADEMARK OFFICE

CERTIFICATE OF CORRECTION

PATENT NO. : 4,137,586

DATED : February 6, 1979

INVENTOR(S) : Karla R. Evert

It is certified that error appears in the above–identified patent and that said Letters Patent are hereby corrected as shown below:

Column 3, line 42, the second use of the word "high" should be changed to --heat--.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*